United States Patent [19]

Hochreuter

[11] 4,001,285

[45] Jan. 4, 1977

[54] AMIDOPOLYAMINESULFONATES

[75] Inventor: Richard Hochreuter, Oberwil, Switzerland

[73] Assignee: Sandoz Ltd., Basel, Switzerland

[22] Filed: Feb. 3, 1975

[21] Appl. No.: 546,524

Related U.S. Application Data

[63] Continuation of Ser. No. 274,232, July 24, 1972, abandoned.

[30] Foreign Application Priority Data

July 27, 1971 Switzerland ..... 11040/71

[52] U.S. Cl. ..... 260/401; 260/457; 260/459 A; 260/458 R; 260/465 D; 260/465 F; 260/501.12; 260/513 N; 260/513 B; 252/8.7; 252/106

[51] Int. Cl.[2] ..... C07C 143/90

[58] Field of Search ..... 260/501.12, 513 N, 401

[56] References Cited

UNITED STATES PATENTS

| | | | |
|---|---|---|---|
| 2,004,476 | 6/1935 | Barz et al. | 260/401 |
| 2,312,395 | 3/1943 | Engel et al. | 260/401 |
| 2,781,376 | 2/1957 | Mannheimer | 260/401 |
| 3,632,613 | 1/1972 | Elliot et al. | 260/401 |

FOREIGN PATENTS OR APPLICATIONS

| | | | |
|---|---|---|---|
| 954,627 | 12/1949 | France | 260/513 N |
| 529,382 | 11/1940 | United Kingdom | 260/513 N |
| 1,037,645 | 8/1966 | United Kingdom | 260/501.12 |

*Primary Examiner*—James O. Thomas
*Assistant Examiner*—Nicky Chan
*Attorney, Agent, or Firm*—Gerald D. Sharkin; Richard E. Vila; Thomas C. Doyle

[57] ABSTRACT

The invention provides novel compounds of formula

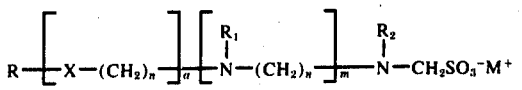

I in which

R signifies a hydrocarbon radical of 5 to 22 carbon atoms, which may be substituted, $R_1$ and $R_2$, which may be the same or different, each signifies a hydrogen atom or a lower alkyl radical which may be substituted, provided that at least one of $R_2$ and $R_1$ or the $R_1$'s signifies hydroxyalkyl or carboxyalkyl, in which the alkyl radical contains 1 to 4 carbon atoms, or a radical of formula $—CH_2SO_3^-M^+$, $—CH_2—CH_2—O)_pH$, $—CH_2—CH(CH_3)O)_pH$, $—CH_2—CH_2—CN$ or $—CH_2—CH_2CONH_2$,

*p* signifies 1 to 10,

X signifies —CONH—,

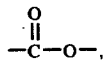

—O— or —S—,

*m* signifies 0 to 6,

*n* or the *n*'s, which may be the same or different when *m* is greater than 1, each signifies from 1 to 8,

*a* signifies 0 or 1 and $M^+$ signifies hydrogen, an ammonium cation or an equivalent of a metal cation, and quaternary ammonium derivatives thereof, useful as textile finishing agents.

12 Claims, No Drawings

AMIDOPOLYAMINESULFONATES

This is a continuation of application Ser. No. 274,232 filed July 24, 1972 now abandoned.

This invention relates to novel compounds useful as finishing agents for textiles.

More particularly, this invention provides compounds of formula I,

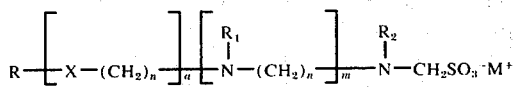

I in which

R signifies a hydrocarbon radical of 5 to 22 carbon atoms, which may be substituted, $R_1$ and $R_2$, which may be the same or different, each signifies a hydrogen atom or a lower alkyl radical which may be substituted, provided that at least one of $R_2$ and $R_1$ or the $R_1$'s signifies hydroxyalkyl or carboxyalkyl, in which the alkyl radical contains 1 to 4 carbon atoms, or a radical of formula $-CH_2SO_3^-M^+$, $+CH_2-CH_2-O)_pH$, $+CH_2CH(CH_3)O)_pH$, $-CH_2-CH_2-CN$ or $-CH_2-CH_2CONH_2$, $p$ signifies 1 to 10, X signifies —CONH—,

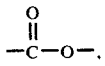

—O— or —S—, $m$ signifies 0 to 6, $n$ or the $n$'s, which may be the same or different when $m$ is greater than 1, each signifies from 1 to 8, a signifies 0 or 1 and $M^+$ signifies hydrogen, an ammonium cation or an equivalent of a metal cation, and quaternary ammonium derivatives thereof.

R preferably signifies a linear, branched or alicyclic hydrocarbon radical, for example pentyl, hexyl, heptyl, octyl, nonyl, decyl, undecyl, dodecyl, tridecyl, hexadecyl, octadecyl, nonadecyl, eicosyl and docosyl, an alkenyl radical, for example tetradecenyl and octadecenyl, or an aryl or aralkyl radical, for example phenyl, phenylmethyl, phenylethyl, phenylpropyl or phenylbutyl. Suitable substituents on such aryl radicals include hydroxyl and cyano.

Suitable lower alkyl radicals for $R_1$ and $R_2$ are alkyl radicals of 1 to 4 carbon atoms, for example methyl, ethyl, propyl, isopropyl, butyl. Suitable hydroxy- and carboxyalkyl radicals include hydroxyethyl, hydroxypropyl, carboxymethyl, carboxyethyl and carboxypropyl. $R_1$ or $R_2$ preferably signifies $-CH_2SO_3^-M^-$.

Suitable metal ions include alkali and alkaline earth metal, e.g. sodium, potassium, magnesium, calcium and barium, ions. Suitable ammonium cations include the ammonium cation itself and ammonium cations derived from ethanolamine, diethanolamine or triethanolamine.

The preferred quaternary ammonium salts are those derived from compounds of formula II, $R_3—A$ II in which $R_3$ signifies a lower alkyl or alkenyl radical which may be substituted, and A signifies a radical convertable into an anion.

$R_3$ may suitably signify an alkyl or alkenyl radical of 1 to 12, preferably 1 to 8, carbon atoms which may be substituted, for example by amide halogen, e.g. chlorine, hydroxy, phenyl, halophenyl or cyanophenyl. $R_3$ preferably signifies methyl, ethyl, propyl, chloromethyl, 2-chloroethyl, 2-hydroxyethyl, benzyl, halobenzyl or cyanobenzyl. A may for example, signify halogen or sulphate.

Preferred compounds of formula II include lower alkyl or alkenyl halogen compounds and di-lower alkyl sulphates.

X preferably signifies —CONH—, $n$ preferably signifies 2 or 3, and $m$ preferably signifies 0 to 4.

The invention also provides a process for the production of compounds of formula I and quaternary ammonium derivatives thereof, characterised by sulphomethylating a compound of formula III,

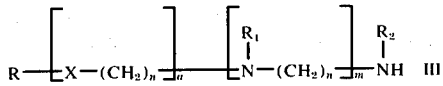

III in which R, X, $a$, $R_1$, $n$, $m$, and , $R_2$ are as defined above, with formaldehyde and a compound of formula IV, $MHSO_3$ IV in which M is as defined above, and, where required, converting any radical $R_1$ or $R_2$ in the resulting product which signifies hydrogen, to another substituent $R_1$ or $R_2$; and, where required, quaternising the resulting compound of formula I.

The reaction of the compounds of formula III and IV is suitably effected at a temperature of from 10° to 110° C, preferably 60° to 95° C. The compound of formula III is preferably mixed with aqueous formaldehyde solution and the compound of formula IV, e.g. sodium bisulphite, is perferably added in the form of an aqueous solution.

The conversion of any nitrogen bound hydrogen atoms in the resulting product to other $R_1$ and/or $R_2$ substituents may be effected in conventional manner. For example, alkyl groups may be introduced by reaction with alkyl halides, the group $-CH_2CH_2CONH_2$ may be introduced by reaction with acrylamide and the group $-CH_2-CH_2-CN$ may be introduced by reaction with acrylonitrile. Furthermore, hydroxyalkyl groups may suitably be introduced by reaction with, for example, alkylene oxides, e.g. ethylene or propylene oxide.

The quaternisation reaction may be carried out in conventional manner. As indicated, the preferred quaternising agents include unsubstituted or substituted lower alkyl or alkylene halides and di-lower alkyl sulphates, e.g. methyl iodide, methyl chloride, 2-chloroethanol, benzyl chloride and dimethyl sulphate.

The resulting products may be isolated and purified using conventional techniques.

The compounds of formula III and IV employed as starting materials, are either known or may be produced in conventional manner from available materials.

The compounds of formula I and their quaternary ammonium salts are useful as finishing agents for textiles comprising natural or synthetic fibres, leather and paper. They are applicable over a wide pH range and show high substantivity for these substrates and import softness and antistatic properties thereto and enhance their power of absorption. They also exercise bactericidal action and reduce the tendency to soiling in the dry state of synthetic fibre textiles, for example nylon carpet. Thus, a combined antistatic, soil repellent and bactericidal finish may be obtained.

Suitable textile substrates include cellulosic fibres, such as cotton, animal fibres such as wool and silk, regenerated cellulosic fibres and polymeric fibres such as polyethylene, polyisobutylene, polyvinyl, e.g. polyvinyl acetate, polyvinyl alcohol, polyvinyl ethers and polyacrylonitrile, polyurethanes and polyamides.

The new compounds produced in accordance with this invention are applicable within a wide pH region of about 2 to 12, preferably 4 to 11. It is of advantage to apply the said compounds in combination with anionic detergents, for example alkylaryl sulphonates, and textile auxiliaries of anionic character such as softeners and optical brightening agents. For example, softening preparations with a predetermined content of anionic optical brightener can be produced, which are suitable for addition to the detergent for washing off the textiles or to the last rinsing water, without the degree of optical whiteness being impaired by the presence of the compound of this invention. In addition to the areas of application already mentioned, the compounds disclosed herein can be employed as dyeing assistants, as fat liquoring agents for leather, and as softening and antistatic agents in paper manufacture.

The disclosed compounds may be applied by any conventional textile finishing technique, for instance by exhaustion, dipping or spraying methods, either from aqueous solution or from organic solvent medium. In exhaust application the textile substrate can be treated at a long liquor to goods ratio with an aqueous solution containing 0.05 to 3 % of the compound relative to the weight of the substrate. In pad application at short liquor ratios, the compound is suitably present at concentrations of 0.1 to 60 grams per litre and the optimum pH region is about 4 to 11. On completion of the treatment, the textile substrate is conveniently hydroextracted or expressed and then dried conventionally at 70° to 140° C.

The following Examples illustrate the invention. The parts and percentages are by weight and the temperatures in degrees centigrade.

EXAMPLE 1

In a sulphonation vessel, a mixture of 510 parts of stearic acid and 292 parts of triethylene tertramine is raised to 160° and held at this temperature until 37 parts of water have distilled, at which point the condensation product reaches an acid number of 2.7. Initially, 97 parts of 37 % formaldehyde solution are added at 90° to 118 parts of the condensation product, then, after 30 minutes, 312 parts of 40 % aqueous sodium bisulphite solution are added, dropwise. The reaction mixture is subsequently held for 4 hours at 89°–90° with constant stirring. A pale yellowish brown paste is formed, which is dispersible in water with a weakly alkaline reaction.

EXAMPLE 2

In a sulphonation vessel, 224 parts of lauric acid are heated to 130° to form a melt, to which 131 parts of dipropylene triamine are added, dropwise. The reaction mixture is heated further to 190° under nitrogen and maintained at this temperature until 20 parts of water have distilled. The excess amine is evaporated with evacuation at 40 mm Hg pressure and the pale yellowish condensation product allowed to cool to 82°. Then 243 parts of 37 % aqueous formaldehyde solution and 780 parts of 40 % aqueous sodium bisulphite solution are allowed to flow in. The batch is held for 2½ hours at 80° to allow for reaction to the end-point. On cooling to room temperature, the product is obtained as a thick, pale yellowish paste which is finely dispersible in water.

EXAMPLE 3

271 Parts of the sulphomethylation product of Example 2 are reacted with (a) 50 parts of dimethyl sulphate or, (b) 25 parts of benzyl chloride to obtain quaternary ammonium derivatives of the invention.

EXAMPLE 4

In accordance with the operating procedure of Example 2, 117 parts of a condensation product formed by the thermal reaction of 124 parts of oleic acid and 41 parts of diethylene triamine are reacted with 73 parts of 37 % formaldehyde solution and 234 parts of 40 % sodium bisulphite solution. The product is 424 parts of a yellow paste which forms fine dispersions in water.

EXAMPLE 5

In manner analogous to Example 4, but employing 67 parts of a product formed from 42.6 parts of caprylic acid and 30.9 parts of diethylene triamine is used in place of the aforesaid 117 parts of the condensation product from oleic acid and diethylene triamine, a clear yellowish liquid of virtually neutral reaction, is obtained.

EXAMPLE 6

In a sulphonation vessel, 108 parts of technical stearic acid are melted at 90° and set with 52.4 parts of dipropylene triamine. The reaction mixture is raised to 185°–190° with distillation of the water of condensation. Towards the end of the reaction, the excess amine is removed by evacuation. The amidation product thus formed is allowed to cool to 86°–90° and then sulphomethylated by the addition of 97 parts of aqueous 37 % formaldehyde solution and 312 parts of aqueous 40 % sodium bisulphite solution. The final product is obtained in the form of a thick, slightly yellowish paste which is finely dispersible in water.

EXAMPLE 7

In manner analogous to Example 6, but employing in place of the aforesaid condensation product from 108 parts of stearic acid and 52.4 parts of dipropylene triamine, a thermal condensation product of (a) 118.8 parts of technical stearic acid and 41.2 parts of diethylene triamine or (b) 140 parts of behenic acid and 41.2 parts of diethylene triamine, further products of the invention are obtained.

EXAMPLE 8

In a sulphonation vessel, a mixture of 80 parts of lauric acid and 52.4 parts of dipropylene triamine is thermally condensed at 190°. The condensation product is reacted at 80° with 64.8 parts of 37 % formaldehyde solution and 208 parts of 40 % sodium bisulphite solution. The reaction results in a soft, pale yellowish paste which forms fine dispersions in water.

EXAMPLE 9

In manner analogous to Example 8, but firstly reacting the condensation product of lauric acid and dipropylene triamine at 82°–84° with 23.2 parts of propylene oxide and then continuing as in Example 8, a further product of the invention is obtained.

EXAMPLE 10

126 Parts of behenyl aminopropylamine are melted at 78° in a reaction vessel. Subsequently, 73 parts of 37 % formaldehyde solution and 234 parts of 40 % sodium bisulphite solution are added dropwise to the melt. The batch is reacted for about 3 hours at 80° and then allowed to cool to room temperature. A soft paste is obtained, which on dilution with water forms opalescent solutions.

EXAMPLE 11

In manner analogous to Example 10 but using 111 parts of stearyl aminopropylamine in place of the 126 parts of behenyl aminopropylamine, a further product of the invention is obtained.

EXAMPLE 12

144 Parts of the condensation product formed as described in Example 10, are quaternated with 30.8 parts of diethyl sulphate in the presence of sodium hydroxide at pH 7 to 8 and 60°. The final product is a soft, slightly yellowish paste which forms fine aqueous dispersions.

EXAMPLE 13

139 Parts of the condensation product from stearyl aminopropylamine and formaldehyde/bisulphite obtained as described in Example 11 are alkylated with 22 parts of monochlorohydrin in the presence of sodium hydroxide for 5 hours at 92° and pH 7 to 8. A viscous, yellowish product is obtained which is finely dispersible in water.

EXAMPLE 14

In manner analogous to Example 13, but using 11.7 parts of monochloracetic acid in the form of the sodium salt for alkylation in place of 22 parts of monochlorohydrin, a further product of the invention is obtained.

EXAMPLE 15

70.5 Parts of the condensation product from 108 parts of technical stearic acid and 52.4 parts of dipropylene triamine produced in accordance with Example 6 are alkylated for 4½ hours at 130° with 46.5 parts of monochloracetic acid in the sodium salt form. Subsequently condensation is carried out at 90° using 16.2 parts of 37 % aqueous formaldehyde solution and 52 parts of 40 % aqueous sodium bisulphite solution. The sulphomethylation product is obtained as a thick yellowish paste which is finely dispersible in water.

EXAMPLE 16

In manner analogous to Example 15, but using 43.5 parts of monochloropropionic acid for alkylation in place of monochloracetic acid and carrying out the alkylation reaction at 95°–100° in the presence of sodium hydroxide, a further product of the invention is obtained.

The foregoing Examples 1 to 16, in general, may comprise a mixture of compounds of the invention. However, the product or the main component of a product mixture in representative Examples, is as set out in the following table with reference to formula Ia,

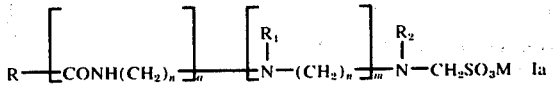

Ia the significances being set out in the table.

| Ex. | R | $R_1$ | $R_2$ | a | n | m | M |
|---|---|---|---|---|---|---|---|
| 1 | $C_{17}H_{35}$ | $CH_2SO_3Na$ | $CH_2SO_3Na$ | 1 | 2 | 2 | Na |
| 2 | $C_{11}H_{23}$ | $CH_2SO_3Na$ | $CH_2SO_3Na$ | 1 | 3 | 1 | Na |
| 4 | $C_{17}H_{35}$ | " | " | 1 | 2 | 1 | Na |
| 5 | $C_7H_{15}$ | " | " | 1 | 2 | 1 | Na |
| 6 | $C_{17}H_{35}$ | " | " | 1 | 3 | 1 | Na |
| 7a | $C_{17}H_{35}$ | " | " | 1 | 2 | 1 | Na |
| 7b | $C_{21}H_{43}$ | " | " | 1 | 2 | 1 | Na |
| 8 | $C_{11}H_{23}$ | $CH_2SO_3Na$ | H | 1 | 3 | 1 | Na |
| 9 | $C_{11}H_{23}$ | $CH_2SO_3Na$ | $CH_2CHCH_3$ (OH) | 1 | 3 | 1 | Na |
| 10 | $C_{22}H_{45}$ | $CH_2SO_3Na$ | $CH_2SO_3Na$ | 0 | 3 | 1 | Na |
| 11 | $C_{18}H_{37}$ | $CH_2SO_3Na$ | $CH_2SO_3Na$ | 0 | 3 | 1 | Na |
| 15 | $C_{17}H_{35}$ | $CH_2COONa$ | $CH_2COONa$ | 1 | 3 | 1 | Na |
| 16 | $C_{17}H_{35}$ | $CH_2CH_2COONa$ | $CH_2CH_2COONa$ | 1 | 3 | 1 | Na |

EXAMPLE 17

A nylon fabric is padded at 20° with an aqueous dispersion of one of the products obtained by the procedures of Examples 2 or 14, expressed on the padding machine and dried. It then shows an increase of 0.2 % on the dry weight. The fabric is conditioned (20° C, 65 % residual moisture, 24 hours). The antistatic action is tested with the aid of a static voltmeter. The measured half-value time for the voltage drop from 100 to 50 volts is less than 0.2 seconds, while the corresponding value for a comparable fabric without the finish is more than 3 minutes. In addition, the finish has antimicrobial properties.

EXAMPLE 18

A cotton towelling fabric which has acquired a rough, brittle handle after repeated washes with a commercial general purpose detergent is treated for 5 minutes in a drum type washing machine with a 2 g/l aqueous solution of one of the products obtained according to Examples 4, 5, 6 or 7. On removal it is hydroextracted and dried. The treatment imparts softness and smoothness to the towelling, with very good absorption power.

EXAMPLE 19

A cotton towelling fabric is treated with constant agitation for 20 minutes at 48° and liquor ratio 30:1 in an aqueous bath containing, on the fabric weight, 0.1 % of the active substance of the product synthesized according to Example 1. It is then hydroextracted and dried. The treated fabric has a soft handle and very good absorption power.

EXAMPLE 20

A cotton poplin fabric is padded with an aqueous liquor containing 10 grams per liter of the product formed according to Example 14 and 1 gram per liter of a commercial optical brightener of anionic character. After the treatment the fabric has a soft, pleasing handle and exhibits a degree of whiteness equal to that obtained when the optical brightener is applied alone.

EXAMPLE 21

Nylon carpeting is padded with an aqueous liquor of the product obtained as specified in Example 10, the expression on the padding machine giving an increase of 0.4 % on the dry weight. The tendency to dry sciling shown by the carpet, determined by the dusting test using vacuum cleaner soil, is substantially reduced.

What is claimed is:

1. A compound of the formula

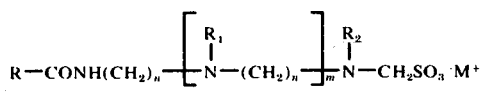

wherein

R is alkyl or alkenyl of 5 to 22 carbon atoms, $R_1$ and $R_2$ are hydrogen or $-CH_2SO_3^-M^+$ with at least one of $R_1$ and $R_2$ being $-CH_2SO_3^-M^+$,

*m* is an integer 0 to 4,

*n* is 2 or 3,

M is hydrogen, ammonium or mono-, di- or triethanolammonium cation or an equivalent of an alkali metal or alkaline earth metal cation.

2. A compound according to claim 1, wherein *m* is 1 or 2.

3. A compound according to claim 2, wherein $R_1$ is $-CH_2SO_3^-M^+$.

4. A compound of claim 3, in which M signifies sodium.

5. A compound of claim 3 of formula,

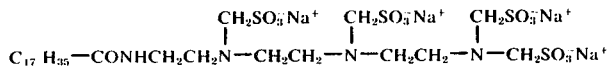

6. A compound of claim 3 of formula,

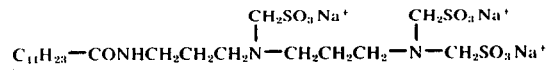

7. A compound of claim 3 of formula,

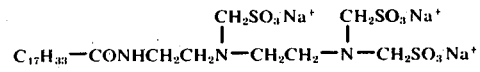

8. A compound of claim 3 of formula,

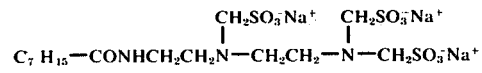

9. A compound of claim 3 of formula,

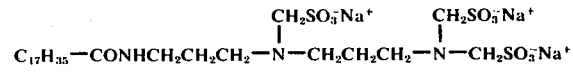

10. A compound of claim 3 of formula,

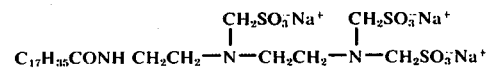

11. A compound of claim 3 of formula,

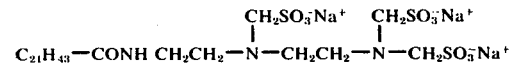

12. A compound of claim 3 of formula,

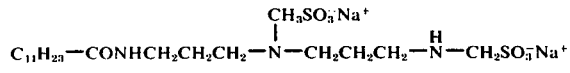

* * * * *